US010368659B2

(12) United States Patent
Resch

(10) Patent No.: US 10,368,659 B2
(45) Date of Patent: Aug. 6, 2019

(54) REFRIGERATED DISPLAY CASE

(71) Applicant: AHT COOLING SYSTEMS GMBH, Rottenmann (AT)

(72) Inventor: Reinhold Resch, St. Peter (AT)

(73) Assignee: AHT COOLING SYSTEMS GMBH, Rottenmann (AT)

( * ) Notice: Subject to any disclaimer, the term of this patent is extended or adjusted under 35 U.S.C. 154(b) by 1 day.

(21) Appl. No.: 15/569,163

(22) PCT Filed: May 13, 2016

(86) PCT No.: PCT/EP2016/058665
§ 371 (c)(1),
(2) Date: Oct. 25, 2017

(87) PCT Pub. No.: WO2016/202486
PCT Pub. Date: Dec. 22, 2016

(65) Prior Publication Data

US 2018/0146799 A1 May 31, 2018

(30) Foreign Application Priority Data

Jun. 16, 2015 (DE) ..... 10 2015 109 611

(51) Int. Cl.
*A47F 3/04* (2006.01)
*F25B 13/00* (2006.01)
(Continued)

(52) U.S. Cl.
CPC ..... *A47F 3/0439* (2013.01); *F25B 13/00* (2013.01); *F25B 49/005* (2013.01); *F25D 11/00* (2013.01); *F25B 2400/12* (2013.01)

(58) Field of Classification Search
CPC .... A47F 3/0439; A47F 3/0447; A47F 3/0469; A47F 3/0443; A47F 5/10; F25D 11/00; B23P 19/04; F25B 2400/12
See application file for complete search history.

(56) References Cited

U.S. PATENT DOCUMENTS

2003/0158704 A1* 8/2003 Triginai ..... B60H 1/00585 702/182
2005/0178999 A1* 8/2005 Minor ..... C09K 5/045 252/68

(Continued)

FOREIGN PATENT DOCUMENTS

DE 202007015832 U1 3/2008
DE 102015106620 A1 11/2016
JP 2004273271 A 9/2004

*Primary Examiner* — Frantz F Jules
*Assistant Examiner* — Martha Tadesse
(74) *Attorney, Agent, or Firm* — McNees Wallace & Nurick LLC

(57) ABSTRACT

A refrigerated display case (1) with at least one unit composed of a plurality of wall groups, namely a bottom group (11), a rear wall group (12), and a top group (13), which delimit a refrigerated chamber (4) at the bottom, at the back, and at the top, and with a cooling device (5) that has a refrigerant circuit and whose components at least include a compressor (51), an evaporator (50), a condenser (52), and an electric control unit (55). A refrigerated display case that is climate-friendly, efficient, and simultaneously safe to operate is achieved in that propane is contained as a refrigerant in the refrigerant circuit, with a filling capacity of more than 150 g.

13 Claims, 3 Drawing Sheets

(51) Int. Cl.
*F25B 49/00* (2006.01)
*F25D 11/00* (2006.01)

(56) References Cited

U.S. PATENT DOCUMENTS

2005/0231146 A1* 10/2005 De Frutos ..... H02P 7/06
318/400.23
2009/0236140 A1* 9/2009 Randall ..... H01R 13/03
174/268
2009/0277205 A1* 11/2009 Matsuda ..... F24F 1/38
62/259.1
2015/0257548 A1* 9/2015 Shapiro ..... F25B 1/005
62/246
2015/0282643 A1 10/2015 Lee et al.
2016/0220040 A1* 8/2016 Resch ..... A47F 3/0447

* cited by examiner

REFRIGERATED DISPLAY CASE

FIELD OF THE INVENTION

The present invention is directed to refrigeration equipment, and more specifically, to a refrigerated display case.

BACKGROUND OF THE INVENTION

The invention relates to a refrigerated display case with at least one unit composed of a plurality of wall groups, namely a bottom group, a rear wall group, and a top group, which delimit a refrigerated chamber at the bottom, at the back, and at the top, and with a cooling device that has a refrigerant circuit and whose components at least include a compressor, an evaporator, a condenser, and an electric control unit.

A refrigerated display case of this kind is disclosed, for example, in DE 10 2012 107 713 A1. It is particularly also suited for use in enclosed spaces and features a stable design and a simple variation of the refrigerated display case size, which also makes it possible to refrigerate large quantities of chilled goods.

Refrigeration equipment with higher refrigeration capacities (for example >2 kW) today is mostly still operated with conventional, generally fluorinated, refrigerants, particularly when used in enclosed spaces. One reason for this is the properties of alternative, natural refrigerants such as carbon dioxide or hydrocarbons, which do not allow natural refrigerants to be easily used in existing systems.

For example, because of their ignitability, hydrocarbons such as propane or butane that are used as natural refrigerants are subject to restrictive regulations (e.g. IEC 600335-2-89), which specify that their filling capacities must be restricted to 150 g and below per refrigerant circuit in refrigeration systems of the conventional type. These quantities, though, are insufficient for higher refrigeration capacities. For the necessary quantities above 150 g, the safety requirements become significantly stricter, particularly in enclosed spaces, so that satisfying these requirements entails a considerable expense.

Because of the high expense, in refrigeration equipment for interior spaces, hydrocarbons are usually used, if at all, in refrigerant circuits with filling capacities of up to a maximum of 150 g so that as a rule, only lower performance classes are operated with hydrocarbons (e.g., see Climate Change 17/2014, Dr. Michael Kauffeld, study entitled "Decentralized Plug-In Cooling Appliances" [Decentral steckerfertige Kühlgeräte], German Federal Environmental Agency 2014, Table 3).

Permitting hydrocarbons to also be used in higher performance classes requires the use of relatively expensive systems such as using a plurality of cooling circuits, each individual one of which has a filling capacity of a maximum of 150 g of refrigerant in order to satisfy the safety requirements. In this case, each circuit must be provided with separate components such as condensers or compressors. A system of this kind is disclosed, for example, in the applicant's DE 10 2015 106 620 (which was not yet published as of the application date).

DE 20 2007 015 832 U1 has disclosed a sales display unit with an electrically driven roller shade. It makes no mention of using a natural refrigerant, particularly with a refrigerant quantity of more than 150 g.

Because of the conflicting problems, natural refrigerants, despite good suitability—for example with regard to greenhouse potential, availability, and thermodynamic properties—have not gained widespread acceptance as a refrigerant in higher performance classes. Instead, fluorinated refrigerants are still used, which can be disadvantageous from an environmental standpoint, particularly with regard to their greenhouse potential.

BRIEF DESCRIPTION OF THE INVENTION

An object of the invention is to produce a refrigerated display case of the type mentioned at the beginning, which is climate-friendly, efficient, and reliable to operate.

This object is attained with the features of claim 1. Here, in connection with the engineering design taught in the preamble, it is specified that propane is used as the refrigerant, with a filling capacity of more than 150 g contained in the refrigerant circuit. As has been discovered in tests conducted by the inventors, higher refrigeration capacities of for example more than 2 kW can be efficiently covered by using propane as a natural refrigerant with its positive properties in terms of greenhouse potential, availability, and thermodynamic properties. In particular, it is possible in this way to also operate larger refrigerated display cases, which can be composed of a plurality of units or display case modules, with only one propane-carrying refrigerant circuit. It is thus possible, for example, to operate a refrigerated display case with a length of more than 2 m, in particular a so-called multiaxial refrigerated display case composed of several (e.g. two or three) display case modules (e.g. each 1.25 m long), with only one refrigerant circuit; even in longer refrigerated display cases, a high cooling capacity is maintained, as also shown in the testing by the inventors. If it is not necessary to use a plurality of refrigerant circuits in a refrigerated display case of this length, then this advantageously reduces complexity since among other things, it is possible to reduce the number of components included in the cooling device, the total length of the refrigerant line, and the assembly complexity. This in turn has an advantageous effect on the installation and maintenance cost and on the operating costs, e.g. as compared to the use of a plurality of refrigerant circuits with filling capacities of less than 150 g.

In connection with the above-mentioned design, a filling capacity of propane of between 300 g and 1500 g in the refrigerant circuit is advantageous for achieving the required cooling capacity. Filling capacities of more than 1500 g, to which even stricter requirements apply, are not necessary. A filling capacity between 500 g and 900 g, in particular between 650 g and 800 g, has turned out to be particularly advantageous since this also makes it possible to operate conventional, e.g. biaxial or triaxial, refrigerated display case sizes with a cooling device that has only one refrigerant circuit. It has surprisingly turned out that a certain filling capacity can be advantageously used, e.g. for a uniaxial and also for a multi-axial refrigerated display case, so that using a cooling device that is design for this purpose, with relatively slight modifications such as evaporator length, it is possible to operate different lengths of refrigerated display cases with the required cooling capacity. Since this permits components that are largely the same to be used for different lengths of display case, this can have an advantageous effect on warehousing and installation measures. But in order to optimize refrigerated display cases of different lengths despite having similar filling capacities in the circuit, it can also be advantageous to install different components.

Advantages, for example with regard to the operation and cooling action, are achieved if the refrigerant circuit has a low-pressure region with an operating pressure of between 0.8 and 2.0 bar and a high-pressure region with an operating pressure of between 20 and 30 bar. The maximum permissible pressure in the low-pressure circuit is 17 bar, for example. In this case, the low-pressure region is downstream of an expansion unit and in particular, includes the evaporator. The high-pressure region extends from the compressor to a point upstream of the expansion unit and includes the condenser.

In an advantageous embodiment variant of the refrigerated display case, the compressor and the condenser are spaced apart from each other, in particular being placed in different wall groups. The evaporator in this case is preferably placed in the rear wall group since, for example, a large area is available here for heat exchange with the refrigerated chamber so that it is possible to achieve an efficient cooling of the chilled goods. In addition, the rear wall group can offer an advantageous installation space. The spaced-apart placement of the compressor and condenser, which is advantageously placed on or in the top group, permits an advantageous placement of these individual components, for example with regard to function, accessibility, use of space, and installation measures. In connection with propane as a refrigerant, this also achieves the advantage that the distributed arrangement of the components can avoid the formation of heat nests since heat is not added due to a number of heat-generating elements being positioned in a narrow space. This measure thus contributes to avoiding high temperatures, which could be critical with regard to the ignition point of propane.

It is advantageous if the compressor is placed beneath the evaporator in the lower region of the rear wall group and at least one fan for assisting the flow of cooling air is positioned above the evaporator in the rear wall group.

For the increased safety requirements in connection with propane, it is beneficial if the fan or fans has/have a motor overtemperature protection. It is thus possible to avoid high motor temperatures of the kind that could occur, for example, with a defective fan motor. The blades of the fan can be advantageously composed of a spark-preventing material, in particular plastic, or they can be correspondingly coated. It is also advantageous to use valves—e.g. solenoid valves—that are especially protected against sparking and/or overheating, in connection with propane. Another advantageous measure lies in eliminating a usually provided brine valve of the kind that is used in prior art refrigerated display cases, i.e. without propane, in a secondary refrigerant circuit and that is placed on or in the top group. In this way, it is possible to eliminate the use of costly protective measures in connection with this valve.

The control device is preferably mounted to the top group, particularly in or on it, where it is not only visually inconspicuous, but at the same time, is easily accessible and can be placed in a protected position. A contribution to a reliable operation in connection with propane is made if the control device is protectively enclosed in a housing, for example a metallic housing; this also offers protection from environmental influences such as moisture influences, particularly also spray water, and damaging influences on electrical components. A housing of this kind also protects electrical components in the control device from the propane-carrying refrigerant circuit.

Another safety-related advantage is achieved if the components of the cooling device in the refrigerant circuit have a maximum surface temperature of less than 300° C., preferably less than 160° C., during operation. This temperature is sufficiently below the 470° C. ignition temperature of propane in order not to induce ignition even in the unlikely event that propane escapes from the refrigerant circuit and a flammable mixture forms.

Preferably, the compressor is embodied in the form of a hermetically sealed, suction-gas-cooled compressor, particularly in the form of a scroll compressor. The hermetically sealed closure prevents propane from escaping into the environment. The cooling prevents excessive heating of the compressor, which is beneficial first from a safety standpoint and second with regard to the service life of the compressor. If the compressor is also positioned in the lowest region of the refrigerant circuit in terms of geodetic altitude, then this promotes the return transport of oil possibly contained in the refrigerant circuit and can therefore avoid places in the circuit where oil collects.

For a reliable operation of the refrigerated display case with propane, it is also advantageous if at least some of the electrical equipment used in the refrigerated display case is provided with spark suppression. In this case, the electrical equipment of the refrigerated display case includes, for example, the power supply of the individual components of the cooling device and also the lighting, the roller shade motor, etc., as well as connections for controlling and/or regulating components such as data connections, and possibly other electrical equipment. Regions in which it is nevertheless impossible to prevent sparking can, for example, be enclosed in a housing.

In this connection, it is advantageous if at least one safety relay is provided in a main circuit of the refrigerated display case, which makes it possible, for example, to monitor contacts in the relay. Preferably, at least some of the electrical components are provided with a spark-suppressing coating. In this case, the components can be electrical components such as capacitors and the like, but can also, for example, be surfaces of components in the cooling device or other mechanical components. A contribution to sparking suppression is also made if the conductor track spacings of the high-voltage lines are at least 3 mm, e.g. between 3 and 5 mm, or at least 5 mm. In a preferred variant, it is also possible to use spark-preventing plug connections. It is also advantageous to use relays and network parts that are equipped with spark suppression, e.g. in the vicinity of the control device.

In an advantageous variant of the refrigerated display case, as shown in FIG. 3, the evaporator 50 has a heat transmission device 65 with aluminum fins and/or copper tubes, which have an inner diameter of between 8 mm and 20 mm, preferably between 10 mm and 15 mm (e.g. 12 mm), and/or a maximum volume of between 3 l and 7 l (e.g. 4 l and/or 6 l).

With a heat exchanger of this kind, it is possible to efficiently cool the refrigerated chamber in connection with propane as a refrigerant, for example based on a high thermal conductivity of the materials used and based on a design that is advantageous to implement. It would also be conceivable to use other heat transmission devices that are suitable for use with propane.

A large amount of flexibility with regard to the installation while maintaining high efficiency can be achieved if the condenser includes a (for example brazed) plate heat exchanger that operates in accordance with the counterflow principle, on whose warm side the flow rate of propane is up to 100 kg/h, preferably up to 80 kg/h, and on whose cold side a glycol/water mixture is used as a coolant in a secondary circuit. In this connection, a mixture of water with 30-50% by volume of (e.g. 38% by volume) propylene glycol has turned out to be particularly suitable, but other mixtures can also be used. The use of a glycol/water mixture, also referred to as brine in connection with cooling appliances, prevents ice from forming in the water. The coolant absorbs the enthalpy, which the propane has conveyed out of the refrigerated chamber, and thus conveys it out of the refrigerant circuit. The refrigerant circuit could also conceivably be air-cooled, but air does not have as good a heat conductivity as a water mixture. In addition, the use of a glycol/water mixture in a secondary circuit permits several cooling units and their heat exchangers to be connected to the secondary circuit and the coolant is in turn conveyed to a central recooling device, where it is cooled down. A recooling device of this kind can thus be spaced apart from the refrigerated display case by means of a supply line and return line; in particular, it can be positioned in a separate room, which brings with it advantages with regard to space and accessibility. Particularly when used with propane, this also achieves the additional advantage that because of its distance from the propane-carrying refrigerant circuit, it is possible to forgo providing special safety measures in the recooling device, as described above by way of example.

A more stable basic design of the refrigerated display case can be achieved in that the refrigerated display case includes at least two display case modules, which can be arranged in a row with each other and are composed of the same kind of module frames, with side frames that have frame profiles and that support the bottom group, the rear wall group, and the top group with respective casing parts and in that the display case modules are provided with the shared evaporator that is positioned in the rear wall group and extends across several or all of the display case modules. By means of a varying number of display case modules, which can be arranged in a row with one another, it is easy to produce refrigerated display cases of different lengths. In this case, a refrigerated display case can be composed of a plurality of display case modules in which a cooling device with a refrigerant circuit is used, which in turn is once again integrated as a module into a refrigerated display case array composed of a plurality of refrigerated display cases. This makes it possible to achieve a high degree of flexibility with regard to design. For a simple design, the side frames are preferably C-shaped when viewed from the side.

An energy-efficient operation of the refrigerated display case can be achieved in that a front roller shade that is operated by a roller shade motor is accommodated in the front section of the top group. In this way, during times in which it does not need to be accessible, the refrigerated chamber can be closed or covered so that the cooling capacity required to achieve the product cooling temperature can be reduced. The roller shade motor, which is advantageously positioned in the overall design anyway, also has a spark-preventing design and/or is accommodated in a protective encapsulation. As explained above, the spark-preventing design can be achieved, for example, by means of spark-preventing plug connections, corresponding coatings, or other measures. The encapsulation is advantageously gas-tight so that in the event of an escape of propane from the refrigerant circuit, no flammable mixture gets into the housing. Thus even in the event of sparking in the roller shade motor or in the event of an overheating due to a defect, any flammable mixture that is present will not ignite. The roller shade motor can also likewise be provided with a motor overtemperature protection so that the motor is no longer operated when a certain temperature is exceeded.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
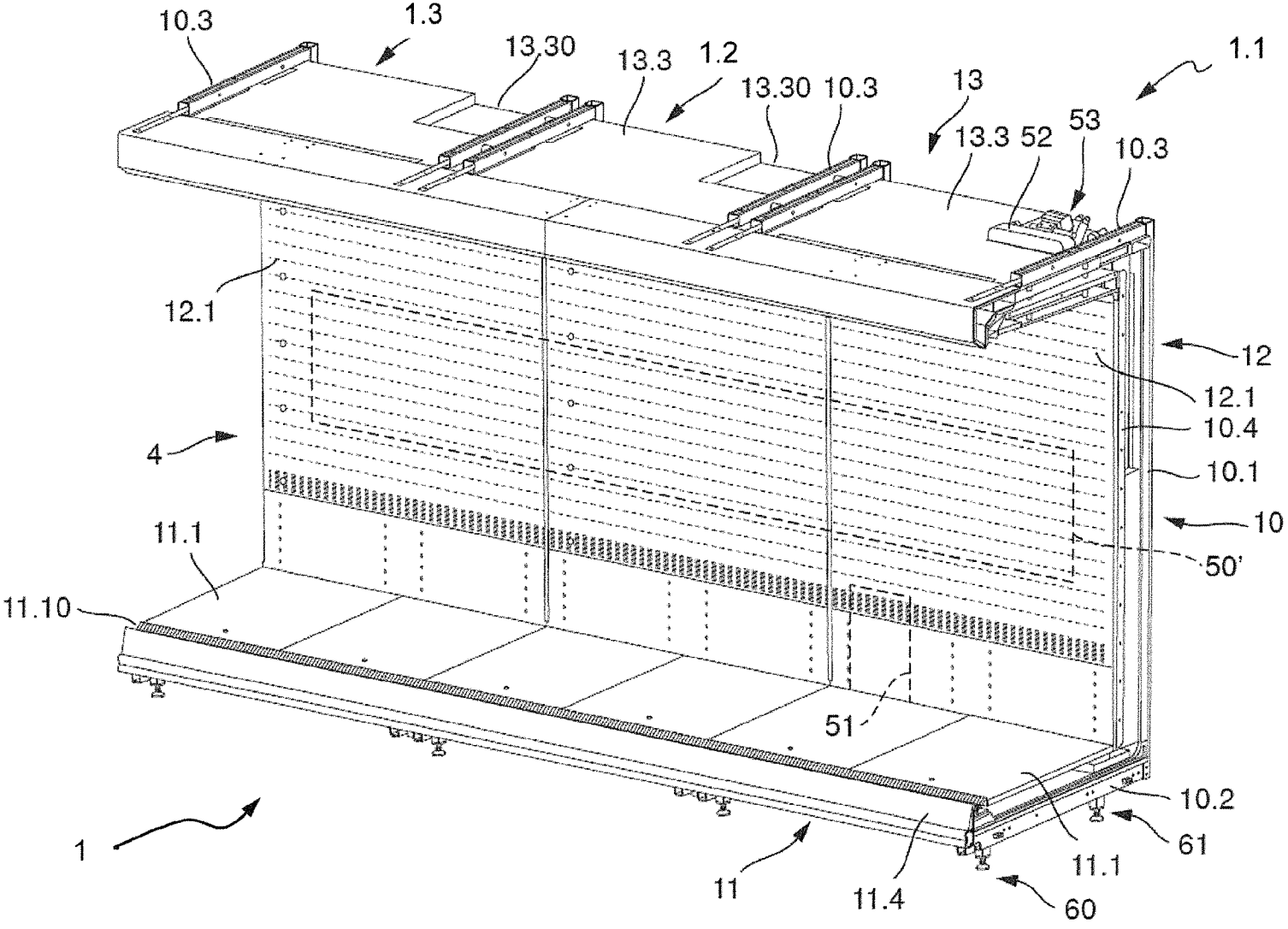
FIG. 1 shows a refrigerated display case with three display case modules a ranged in a row with one another (in a not yet completely assembled state) in a perspective view from the front and to the side.

FIG. 1 shows a refrigerated display case 1 with three display case modules 1.1, 1.2, 1.3 (so-called triaxial embodiment) that is suitable for being set up on a sales floor; at the back, the top, and the bottom, the refrigerated display case 1 encloses a refrigerated chamber 4 that is accessible from the front. The refrigerated display case 1 can be combined with other refrigerated display cases 1 to form a refrigerated display case array; the refrigerated display cases 1 can also be composed of several display case modules 1.1, 1.2, 1.3, (e.g. two in a biaxial embodiment) or also of only one (uniaxial embodiment) so that the length of the refrigerated display case preferably totals the length of one module (generally 1.25 m) or the length of several modules. When in use, preferably side walls are also laterally mounted onto the two sides of the refrigerated display case 1 or refrigerated display case array. The front side can be open and accessible or for special applications, can be provided with at least one door element. For closing purposes, e.g. outside of business hours, the front side can be closed with a roller shade 63, which is positioned in the front top region. When in use, shelves are installed in the refrigerated chamber 4, onto which chilled goods such as meat products, dairy products, or the like are placed on a sales floor.

In order to keep the refrigerated chamber 4 cool, components of a cooling device 5 (see FIG. 2) are integrated into the refrigerated display case 1, in particular a control unit 55.1 of a control device 55 (see FIG. 3), fans 56, 57 for producing or assisting required air flows (see FIG. 3), connecting means 53 including connecting lines 53.1 and, in a refrigerant circuit, an evaporator 50, 50', a compressor 51, a condenser 52, and an expansion valve arrangement. For monitoring purposes, additional pressure switches are integrated into the refrigerant circuit, preferably one each on the high-pressure side and the low-pressure side, which are approved for operation with flammable refrigerants. In addition, pressure transmitters (e.g. one each on the high-pressure side and the low-pressure side), a filter drier, and at least one inspection glass, are placed on the high-pressure side of the refrigerant circuit. The pipe lines of the circuit are preferably composed of copper; brazing is used as a connecting technique.

The condenser 52 can be connected via the corresponding connecting lines 53.1 and via a secondary circuit to a recooling device 54, which has a heat exchanger and is preferably located in a different room. If need be, it is possible, for example, for a larger refrigerated display case array to also include a plurality of similar components of the cooling device 5, in particular a plurality of refrigerant circuits. In the present exemplary embodiment, when the refrigerated display case 1 is embodied as uniaxial, biaxial, or triaxial, it has only one refrigerant circuit.

Propane is conveyed in the refrigerant circuit as a natural refrigerant; the filling capacity of propane is between 650 g and 800 g. This quantity has turned out to be particularly advantageous in the refrigerated display case 1 of the above-mentioned design with a length of between 1 m and 4 m, for example. In longer refrigerated display cases, for example embodied in a triaxial form, it is also conceivable for a refrigerant circuit to contain large quantities of propane, but for safety reasons, this should not exceed 1500 g. Smaller quantities would also be conceivable.

In a number of respects, the refrigerated display case 1 shown in the exemplary embodiments is particularly suitable for use with propane as a refrigerant; a few modifications are carried out by comparison with the variant that is operated with conventional refrigerant. One reason for the good suitability is in particular the modular design with the high flexibility of the component arrangement, both with regard to components of the cooling unit 4 and with regard to other components. The design also offers advantages with regard to efficiency so that the relatively small quantity of preferably 650 g and 800 g of propane used as a refrigerant is sufficient to produce the required refrigeration capacity in the refrigerated chamber 4 of the refrigerated display case 1 and this is in turn beneficial in terms of safety. The design of advantageous embodiment variants of the refrigerated display case 1 is described in greater detail below.

An essential component of each display case module 1.1, 1.2, 1.3 is side frames 10, which are provided on each side thereof, each with a C-shaped design when viewed from the side, with a vertical profile 10.1 along the back, a lower horizontal profile 10.2, which is connected to the latter and extends toward the front, and an upper horizontal profile 10.3, which is connected to the upper end section of the vertical profile 10.1 and extends toward the front. In the depiction shown, the lower horizontal profile 10.2 extends farther toward the front than the upper horizontal profile 10.3. In additional testing, however, it has turned out that an upper horizontal profile 10.3 that is just as long as or longer than the lower horizontal profile 10.2 can be advantageous in order, for example, to support an upper forestructure with a roller shade and a lighting element in a stable fashion without bending. In front of the vertical profile 10.1, spaced apart from it toward the front, a support profile 10.4 is installed between the lower and upper horizontal profile 10.2, 10.3. Between the upper and lower ends of the support profile 10.4 and the upper and lower horizontal profiles 10.3, 10.2, block-like thermally insulating elements are mounted, for example made of stable plastic that provides a good thermal insulation, in order to avoid the presence of thermal bridges extending from the outside to the inside, thus also providing advantageous assembly aids. The lower horizontal profile 10.2 is supported on adjustable level feet 60, 61. The two side frames 10, together with longitudinal elements connecting them, e.g. longitudinal struts and/or casing parts, form stable module frames with frame profiles. The two side frames 10 of each display case module 1.1, 1.2, 1.3 and the module frames support the bottom group 11 by means of their lower horizontal profiles 10.2, support the rear wall group 12 by means of their vertical profiles 10.1 and support profiles 10.4, and support the top group 13 by means of their horizontal profiles 10.3 and achieve a stable design with simple assembly steps. In addition, they ensure a stable sequential arrangement of a plurality display case modules 1.1, 1.2, 1.3 to form the refrigerated display case 1 or refrigerated display case array; the refrigerated display case 1 can be transported as a stable unit by means of a lifting device or vehicle.

In a preferred embodiment according to the exemplary embodiment shown, the condenser 52 with corresponding connecting means 53 is placed in or on the top group 13 in an upper cooling component receptacle 13.30 embodied there in the vicinity of an upper cover 13.3 that is easily accessible from above or behind. A pressure tank of a desiccator/collector unit of the condenser 52 can be acted on with a maximum pressure of up to 30 bar or greater. In this case, it has a high burst pressure of more than 130 bar, for example, so as to assure a large safety margin from the operating pressure for the use of propane. The volume of the pressure tank is between 0.4 l and 1.4 l, preferably between 0.5 l and 0.8 l, and is thus significantly lower than in conventionally used refrigerants, e.g. approximately half as much, depending on which conventional refrigerant is involved. In this connection, the pressure tank has an elongated, cylindrical form, which allows the pressure tank to be placed in a space-saving way in or on the top group.

The compressor 51 is accommodated in the lower region of the rear wall group 12 behind an inner cover 12.1 that delimits the refrigerated chamber 4 at the back, in a receiving chamber (not shown in greater detail) of a receiving unit. In this case, it is situated in the lowest region of the refrigerant circuit in terms of geodetic altitude. In the middle region of the rear wall group 12, the evaporator 50, 50' is likewise positioned behind the inner cover 12.1 and is mounted in position using elements of the receiving unit. As is clear from FIG. 1, the evaporator 50' extends continuously across all three display case modules 1.1, 1.2, 1.3, while in a biaxial or triaxial design, the compressor 51 and the condenser 52 for all of the display case modules 1.1, 1.2, 1.3 of the refrigerated display case 1 are positioned together in only one display case module 1.1 and in fact in the exemplary embodiment shown in FIGS. 1 and 2, in display case module 1.1 on the right (module b) and are mounted to the evaporator 50' by means of corresponding connecting lines with the interposition of relevant intermediate elements of the cooling device 5 such as the expansion valve or throttle. The arrangement in only one display case module 1.1, 1.2, 1.3 is advantageous when using propane to the extent that it is possible to reduce the line length in comparison to an arrangement in different display case modules, thus making it possible to reduce the number of potential leakage points. In addition, this assures a sufficient distance between the compressor 51 and the condenser 52 through the arrangement in different wall groups of the refrigerated display case 1, namely the rear wall group 12 and the top group 13, in order, for example, to avoid a heat transmission from the compressor 51 to the condenser 52 and to prevent the formation of heat nests of excessive temperature development.

With a bottom cover 11.1 situated in its upper region, the bottom group 11 delimits the bottom of the refrigerated chamber 4 and on its front end, supports a covering grating 11.10, which is provided with air passage holes, in particular air passage slots, and a front cover 11.4 with a bumper strip or trim strip in the lower front edge region.

Figure 2:
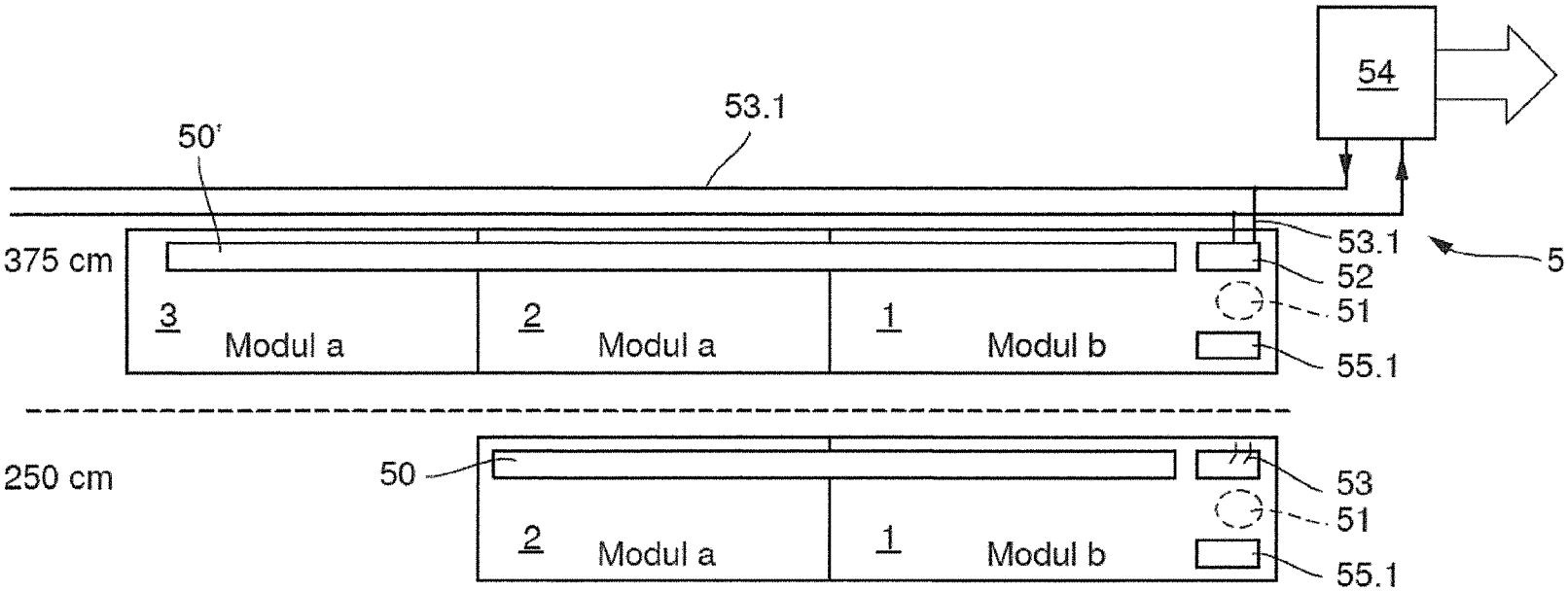
FIG. 2 is a schematic view of two refrigerated display cases composed of two display case modules and three display case modules, respectively, with schematically depicted components of a cooling device that is connected to a central recooling device.

As shown in FIG. 2, an advantageous exemplary embodiment of the refrigerated display case 1 lies in the fact that only one display case module 1.1 is provided with all of the components of a cooling device except for the possibly provided central recooling device 54 with the associated supply and return connecting lines 53.1 (module with design type b), whereas the rest of the display case modules of a refrigerated display case array are only provided with an evaporator 50, 50', the evaporator 50, 50' being advantageously embodied as a continuous unit (modules of design type a). If the refrigerated display case 1 is composed of only one display case module 1.1, then this display case module 1.1 advantageously constitutes a module of design type b. The evaporator of the modules of design type a is connected via corresponding connecting means 53 including connecting lines 53.1 and possibly electrical cabling for a signal transmission (sensors, control) and electrical energy supply to the remaining relevant components of the cooling device in the display case module 1 of design type b. In order to also ensure a refrigerated display case 1 that is protected from ignition even when propane is used as a refrigerant, the electrical cabling and possibly other components are particularly protected from sparking, for example by means of spark-preventing plug connections and/or special coatings. The spacings of the conductor tracks, particularly from high-voltage lines that are used to supply power to electrical components of a higher power consumption, are larger than in the refrigerated display case embodiment with conventional refrigerant, e.g. at least 3 mm or at least 5 mm, in order to avoid a voltage flashover no matter what. In addition, a safety relay is provided, for example in a main power line; such an element can also be positioned in other critical areas. The control device 55 that contains a large number of electrical components is also enclosed or encapsulated by a housing and is thus protected from the environment.

All of the display case modules 1.1, 1.2, 1.3, however, can be prepared in the same way for accommodating all of the required components of the cooling device 5 and can also be provided with preinstalled sections of the connecting lines 53.1 and connecting means for a simple, quick connection between the cooling components of the display case modules and possibly with the central recooling device 54 so that modules of a design type with a low level of assembly complexity can be retrofitted into a module of the other design type or possibly of still another design type with other or additional components of the cooling device. It is also possible, e.g. in a refrigerated display case array with a larger number of display case modules, for there to be more than just one display case module of design type b or of a design type with additional components of the cooling device.

An evaporator 50, 50' that extends across a plurality of display case modules 1.1, 1.2, 1.3 can also be subsequently inserted with relative ease between the relevant vertical profiles 10.1 and the support profiles 10.4 spaced apart from and in front of these vertical profiles and for these display case modules to be fastened to the vertical profiles and/or to an intermediate partition, in particular a partition wall 12.2. The relevant vertical profiles 10.1 and the support profiles 10.4 spaced apart from and in front of them advantageously form an intermediary space that can even extend across a plurality of display case modules 1.1, 1.2, 1.3. The subsequent installation is carried out, for example, by inserting the heat exchanger of the evaporator 50, 50' from a side parallel to the rear wall plane or from the front, after relevant support profiles 10.4 have been removed, which are subsequently reinstalled again. The particular assembly method of the support profiles 10.4 therefore achieves a simple installation and removal. It is thus easily possible, for example, to extend a one-module or two-module refrigerated display case 1 into a two-module or three-module one merely by just exchanging the evaporator 50 to 50'. In this case, other essential components of the refrigerant circuit can be retained since with a uniform filling capacity, which lies between 650 g and 800 g, for example, it is possible to efficiently operate both uniaxial and multi-axial (e.g. biaxial or triaxial) refrigerated display cases, as has turned out to be the case in testing by the inventor. In order to optimize each refrigerated display case embodiment, however, it is also possible to install a variety of components.

As also shown in FIG. 2, in the design shown, only one display case module 1.1 with the prepared connecting means 53, which for example include quick couplings and controllable valves, has to be connected to the central recooling device 54, while the remaining display case modules 1.2, 1.3 are merely connected to one another in a simple way via the integrated connecting means 53. The central recooling device 54 in this case is generally connected via the secondary circuit to the condenser 52 of the relevant display case module 1.1 (design type b); preferably, a brine or a glycol/water mixture is used as the coolant in the secondary circuit. For the condenser 52, it is possible, for example, to use a compact plate heat exchanger or tube heat exchanger, in particular a brazed plate heat exchanger that operates in accordance with the counterflow principle. Heat accumulating in the central recooling device 54 can be conveyed away for another use of the thermal energy, as indicated with the arrow at the top right. With propane as a refrigerant, the central recooling device 54 also brings the advantage that because of the distance from the refrigerated display case 1, it is not subject to increased safety requirements and thus no additional measures are required in order to make it safe.

Figure 3:
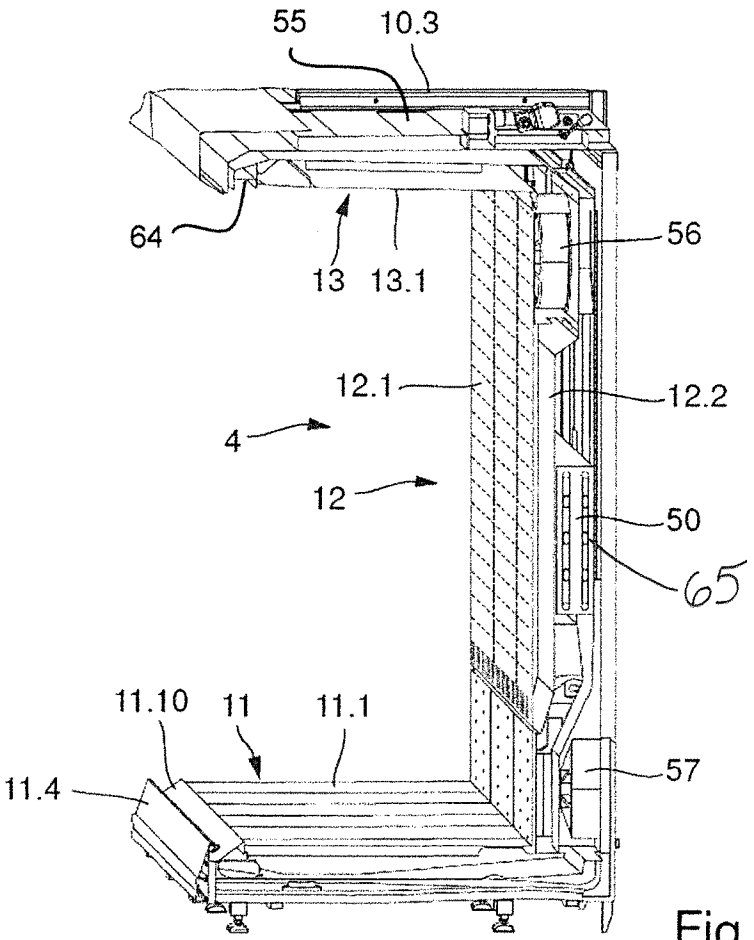
FIG. 3 is a perspective view of a refrigerated display case viewed diagonally from the side and front, in a depiction that is open at the side.
Figure 4:
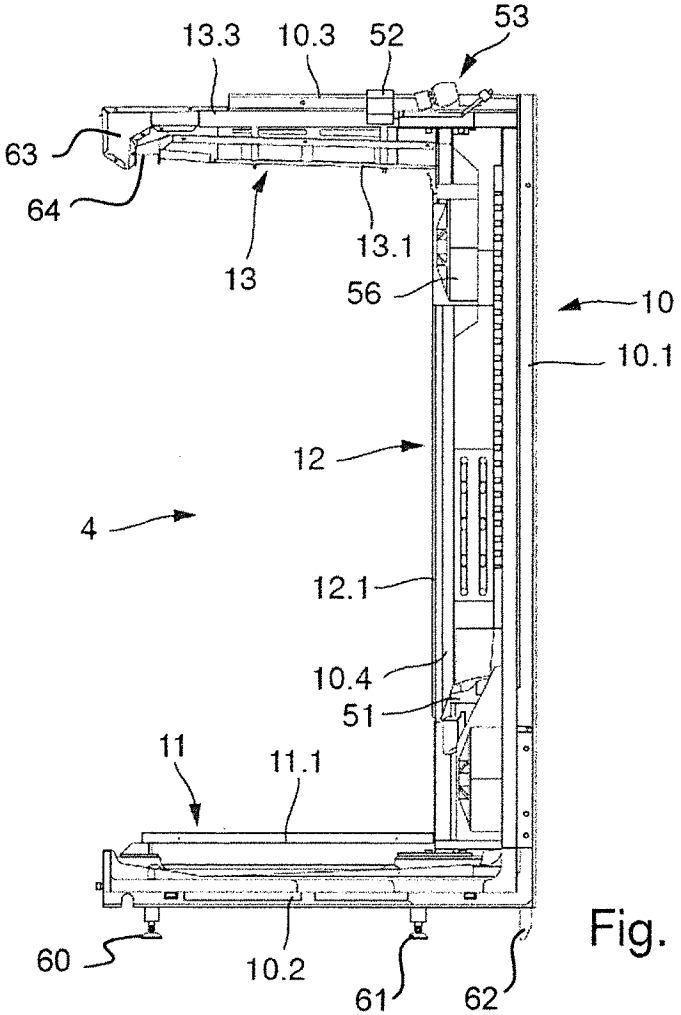
FIG. 4 shows an open side view of a display case module.

As shown in FIGS. 3 and 4, the bottom group 11, the rear wall group 12, and the top group 13 are embodied as multi-layered, with intermediate spaces that transition into one another in order to form channels for the air flow. The air flow is produced or assisted by means of fans 56, 57, which are embodied, for example, as radial fans or as diagonal fans and one of which is positioned in the lower region of the rear wall group 12 and one or two of which is/are positioned in the upper region thereof in the exemplary embodiment shown. In this case, the upper fan or fans 56 produce(s) the air flow through the evaporator 50, 50', from the bottom to the top. A part of the cooling air flow produced by the evaporator 50, 50' is conveyed back down again on the back side of the inner cover 12.1 and flows through ventilation slots provided in the inner cover 12.1 and into the refrigerated chamber 4 in order to keep the latter at the required cooling temperature. In particular, the fan or fans 56 positioned above the evaporator 50, 50' has/have turned out to be particularly effective and advantageous for safety, it being possible to eliminate the one underneath the evaporator 50, 50'.

In order to achieve a good transmission of the cooling capacity to the refrigerated chamber 4, the bottom cover 11.1, the inner cover 12.1, and the lower cover 13.1 of the top group 13 are composed of thin-walled plates, in particular of metal or plastic, which are also easy to handle and clean. The plates of the bottom cover 11.1 are advantageously segmented in the width direction and extend from the covering grating 11.10 in the front region of the bottom group 11 to the lower region of the inner cover 12.1 of the rear wall group 12. The plates of the inner cover 12.1 of the rear wall group 12 are advantageously segmented in the vertical direction and extend across the entire width between the two side frames 10 of a display case module 1.1, 1.2, 1.3; a plurality of vertical plates positioned one above the other can be inserted and removed in an easy-to-handle way in order, for example, to expose, clean, install, or remove relevant components of the cooling device 5.

As is also shown in FIGS. 3 and 4, downward-protruding tilt prevention devices 62 are mounted to the lower end section of the vertical profiles 10.1 and advantageously permit adaptation to irregularities in the floor, for example due to springy or elastic intermediate elements and/or adjusting elements. A lighting element 64 can be provided in the front region of the bottom group 11 and/or top group 13. In this case, the lighting element 64 is advantageously embodied in the form of an LED light with drivers that are matched to it in order to not constitute an ignition source in connection with the refrigerant used. The roller shade 63 is advantageously positioned in the front, upper region in order, for example outside business hours, to close the refrigerated chamber at the front and to reduce refrigeration energy consumption. The motor for driving the roller shade 63 is likewise provided with spark-preventing means. For example, it is accommodated in a protective encapsulation and/or spark-generating transition points must be avoided in the vicinity of current-carrying rotating parts.

All in all, the above embodiments disclose a refrigerated display case 1 in a higher performance class (for example >2 kW), which, through the use of propane as a refrigerant, can be operated in a climate-friendly, efficient, and simultaneously safe way. This is due to the fact that one the one hand, the embodiment variants shown have a basic design with components arranged in an advantageous distribution; the design of the display case modules 1.1, 1.2, 1.3 and refrigerated display case 1 composed thereof enable a safer operation with propane. In this connection, modifications were carried out, which in complex testing, have turned out to be beneficial to operational safety. With the measures according to the invention, a refrigerated display case with a filling capacity of more than 150 g of propane is achieved, which satisfies the increased safety requirements that apply to filling capacities of this kind.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A refrigerated display case (1) with at least one unit composed of a plurality of wall groups, namely a bottom group (11), a rear wall group (12), and a top group (13), which delimit a refrigerated chamber (4) at a bottom, at a back, and at a top, and with a cooling device (5) that has a refrigerant circuit at least including a compressor (51), an evaporator (50), a condenser (52), and a control device (55), characterized in that propane is contained as a refrigerant in the refrigerant circuit, with a filling capacity of between 300 g and 1500 g the refrigerant circuit has a low-pressure region with an operating pressure of between 0.8 and 2.0 bar and a high-pressure region with an operating pressure of between 20 and 30 bar; the compressor (51) and the condenser (52) are positioned spaced apart from each other, particularly in different wall groups; the evaporator (50) is positioned in the rear wall group (120); the compressor (51) is positioned beneath the evaporator (50) in a lower region of the rear wall group (12) and at least one fan (56) for assisting a flow of cooling air is positioned above the evaporator (50) in the rear wall group (12); the at least one fan (56, 57) has a motor over temperature protection; the cooling device (5) in the refrigerant circuit has a maximum surface temperature of less than 300° C. during operation; the compressor (51) is a hermetically sealed, suction-gas-cooled compressor, and the compressor (51) is situated in a lowest region of the refrigerant circuit in terms of geodetic altitude.

2. The refrigerated display case (1) according to claim 1, characterized in that the propane is contained as the refrigerant in the refrigerant circuit, with a filling capacity between 500 g and 900 g.

3. The refrigerated display case (1) according to claim 1, characterized in that the control device (55) is mounted to the top group (13), wherein in response to the control device (55) being mounted in the top group (13), the control device (55) is protectively enclosed in a housing.

4. The refrigerated display case (1) according to claim 1, characterized in that at least a portion of electrical components of a plurality of the electrical components used in the refrigerated display case (1) is provided with spark suppression.

5. The refrigerated display case (1) according to claim 4, characterized in that at least one safety relay is provided in a main circuit of the refrigerated display case (1), the at least a portion of electrical components of the plurality of the electrical components is provided with a spark-suppressing coating, conductor track spacings of high-voltage lines are at least 3 mm, spark-preventing plug connections are used.

6. The refrigerated display case (1) according to claim 1, characterized in that the evaporator (50) has a heat transmission device (65) with aluminum fins and/or copper tubes that have an inner diameter of between 10 mm and 15 mm and/or a maximum volume of between 3 l and 7 l.

7. The refrigerated display case (1) according to claim 1, characterized in that the condenser (51) includes a plate heat exchanger that operates in accordance with a counterflow principle, on whose warm side a flow rate of the propane is up to 100 kg/h, and on whose cold side a glycol/water mixture is used as a coolant in a secondary circuit.

8. The refrigerated display case (1) according to claim 1, characterized in that the refrigerated display case (1) includes at least two display case modules (1.1, 1.2, 1.3), which are arranged in a row with each other and are composed of module frames, with side frames (10) that have frame profiles and that support the bottom group (11), the rear wall group (12), and the top group (13) with respective casing parts and the display case modules (1.1, 1.2, 1.3) are provided with a shared evaporator (50') that is positioned in the rear wall group and extends across a plurality of the at least two display case modules (1.1, 1.2, 1.3).

9. The refrigerated display case (1) according to claim 1, characterized in that side frames (10) are C-shaped when viewed from the side.

10. The refrigerated display case (1) according to claim 1, characterized in that a front roller shade (63) that is operated by a roller shade motor is accommodated in the front section of the top group (13) and the roller shade motor has a spark-preventing design and/or is accommodated in a protective encapsulation.

11. The refrigerated display case (1) according to claim 2, characterized in that the refrigerant circuit has a low-pressure region with an operating pressure of between 0.8 and 2.0 bar and a high-pressure region with an operating pressure of between 20 and 30 bar.

12. The refrigerated display case (1) according to claim 4, characterized in that at least one safety relay is provided in a main circuit of the refrigerated display case (1), the at least a portion of electrical components of the plurality of the electrical components is provided with a spark-suppressing coating, conductor track spacings of high-voltage lines are at least 3 mm, or spark-preventing plug connections are used.

13. A refrigerated display case (1) with at least one unit composed of a plurality of wall groups, namely a bottom group (11), a rear wall group (12), and a top group (13), which delimit a refrigerated chamber (4) at a bottom, at a back, and at a top, and with a cooling device (5) that has a refrigerant circuit at least including a compressor (51), an evaporator (50), a condenser (52), and a control device (55), characterized in that propane is contained as a refrigerant in the refrigerant circuit, with a filling capacity of between 300 g and 1500 g.

* * * * *